US007784126B2

(12) United States Patent
Meissner et al.

(10) Patent No.: US 7,784,126 B2
(45) Date of Patent: Aug. 31, 2010

(54) OPERATING TABLE

(75) Inventors: Joerg Meissner, Jena (DE); Arnd Kuchenbecker, Saalfeld (DE); Manfred Fehn, Saalfeld (DE); Sven Steffens, Poessneck (DE)

(73) Assignee: Trumpf Medizin Systeme GmbH, Saalfeld (DE)

( * ) Notice: Subject to any disclaimer, the term of this patent is extended or adjusted under 35 U.S.C. 154(b) by 0 days.

(21) Appl. No.: 12/183,309

(22) Filed: Jul. 31, 2008

(65) Prior Publication Data

US 2009/0031497 A1 Feb. 5, 2009

(30) Foreign Application Priority Data

Aug. 3, 2007 (EP) ..... 07015262

(51) Int. Cl.
*A47B 71/00* (2006.01)

(52) U.S. Cl. ..... 5/600; 177/144; 177/DIG. 9

(58) Field of Classification Search ..... 5/600, 5/607, 611, 613, 616, 618, 619; 403/27, 403/57, 58; 73/779, 862.333, 862.69; 177/144, 177/DIG. 9; 108/7, 10, 147
See application file for complete search history.

(56) References Cited

U.S. PATENT DOCUMENTS

| | | | | |
|---|---|---|---|---|
| 4,869,266 | A | 9/1989 | Taylor et al. | |
| 5,022,275 | A * | 6/1991 | Satoh et al. | 73/862.335 |
| 5,428,851 | A * | 7/1995 | Shore et al. | 5/87.1 |
| 5,528,782 | A * | 6/1996 | Pfeuffer et al. | 5/611 |
| 6,640,363 | B1 * | 11/2003 | Pattee et al. | 5/601 |
| 6,822,571 | B2 * | 11/2004 | Conway | 340/573.1 |
| 2004/0200001 | A1 * | 10/2004 | Stolze et al. | 5/601 |

FOREIGN PATENT DOCUMENTS

| | | |
|---|---|---|
| DE | 19612091 | 3/1997 |
| EP | 1634558 | 3/2006 |
| EP | 1635153 | 3/2006 |
| WO | WO9925303 | 5/1999 |
| WO | 2006089399 | 8/2006 |

* cited by examiner

*Primary Examiner*—Peter M Cuomo
*Assistant Examiner*—Nicholas Polito
(74) *Attorney, Agent, or Firm*—Fish & Richardson P.C.

(57) ABSTRACT

The invention relates to an operating table having a support column and a table panel mounted on the support column. In order to facilitate improve monitoring of a patient on the table panel, the operating table has a force measurement system for determining the weight of the table panel and of the patient on the table panel.

17 Claims, 3 Drawing Sheets

OPERATING TABLE

CROSS REFERENCE TO RELATED APPLICATION

This application claims priority under 35 USC §119(a) from European patent application EP 07 015 262.4, filed Aug. 3, 2007. The complete disclosure of this priority application is incorporated herein by reference.

TECHNICAL FIELD

The invention relates to an operating table having a support column and a table panel mounted on the support column.

BACKGROUND

Operating tables having a support column and a table panel mounted on the column are known in the art. A patient may be supported on the table panel during an operation or an investigation

SUMMARY

In one aspect, the disclosure herein features an operating table having a support column and a table panel mounted on the support column, the operating table having a force measurement system for determining the weight of the table panel and of a patient on the table panel.

This gives for example the opportunity for the weight of the patient to be monitored during an operation. Monitoring of this kind is in particular advantageous if the patient suffers great loss of blood.

The weight of the patient is ascertained by means of the force measurement system and may for example be shown on a display.

It is advantageous if the center of gravity of the table panel with the patient thereon can be determined by means of the force measurement system. The mechanical loading on the support column is determined by the weight of the patient and the distribution of the patient's weight, the weight and the location of the center of gravity of the table panel, and the weight and center of gravity of any further supporting segments and/or optional apparatus secured to the table panel. It is therefore advantageous if the total mechanical loading on the support column can be ascertained by the force measurement system.

In an advantageous embodiment, the force measurement system has a plurality of sensors arranged at a spacing from one another, the sensors being connected to central measuring electronics. The use of a plurality of sensors enables the load distribution to be ascertained, i.e. the distribution of the load acting on the support column. Accordingly, a serious imbalance of the load distribution can be counteracted, in order to prevent in good time tipping over of the operating table.

The table panel is often pivotable and/or displaceable relative to a baseplate of the support column. For example, it may be provided that the table panel is pivotable about a pivot axis which is aligned parallel or at right angles to the longitudinal axis of the table panel, for example as disclosed in US 2007/0107122, the full disclosure of which is incorporated by reference. This gives the opportunity for the upper body of a patient lying on the table panel to be raised or lowered or also to tilt the patient about the longitudinal axis of the table panel. It may also be provided that the table panel is displaceable relative to the support column in the longitudinal or transverse direction of the table panel. For the pivoting and displacement, drive assemblies are used, with which an electronic control unit is associated. In the case of embodiments of this kind, it is particularly advantageous for the maximum pivot angle and the maximum displacement relative to a neutral position of the table panel to be controllable in dependence on an output signal of the force measurement system. This gives the opportunity, according to the weight of the patient, for the maximum pivot angle and the maximum displacement to be delimited, so that in the course of pivoting or displacing of the table panel, the tipping stability of the operating table is in no way affected. If the patient is of only relatively low weight, then on the basis of the output signal of the force measurement system, a greater maximum pivot angle or a greater maximum displacement is provided, than is the case for a patient of relatively great weight. Fixed prescribed maximum pivot angles and maximum displacements are therefore not required, and by contrast the maximum pivot angle and likewise the maximum displacement are determined substantially by the output signal of the force measurement system.

Preferably, the table panel is releasably connected to the support column, for example as disclosed in US 2004/0200001, the full disclosure of which is incorporated herein by reference. The table panel can therefore be removed from the support column and as required mounted thereon. This gives the opportunity for the patient to be laid on the table panel outside the operating room. The table panel with the patient supported on it can subsequently be mounted on the support column. After an operation has been completed, the table panel with the patient can be removed again from the support column and transferred to a recovery room. The number of times the patient has to be transferred between beds can be reduced by this.

The force measurement system is preferably incorporated into the support column. This enables known table panels of very different kinds to be used for the operation table, the panels preferably being releasably connectible to the support column. By means of the force measurement system, the load exerted on the support column by the table panel and a patient thereon, and preferably also the load distribution, can be ascertained.

When mounting the table panel on the support column and when taking the table panel off the support column, lateral forces and moments occurring at the guide surfaces of the table panel and support column, which result from a possible tilting of the table plate on account of unfavorable centers of gravity, may be ascertained by the force measurement system and processed by a control unit of the operating table so that the support column is pivoted in its upper region in such a way that lateral forces no longer occur. This facilitates mounting and removal of the table panel, respectively onto and off the support column.

It is advantageous for the support column to have a pivotable column head. The column head may for example be displaceable relative to a column pillar as to its height and/or be pivotable about a horizontal pivot axis. The table panel may be mounted on the column head. At least one sensor of the force measurement system is preferably incorporated into the column head. In particular, it may be provided that all sensors of the force measurement system and preferably also measuring electronics for the force measurement system are incorporated into the column head. It may for example be provided that the column head has a head plate on which the table panel can be mounted and which is pivotable relative to a support plate of the support column and is preferably adjustable as to its height. The force measurement system is preferably located between the head plate and the support plate.

It is especially advantageous for the table panel to be mounted by way of a plurality of supporting elements, preferably three supporting elements, on a support plate of the support column, the load acting on each supporting element being detectable by means of at least one sensor of the force measurement system. The force measurement system thus has a plurality of sensors which record the load acting on the supporting elements. This enables, on the one hand, the entire load which acts on the support plate to be determined by means of the force measurement system, and on the other hand, the load distribution to be ascertained. Determination of a load distribution of this kind is in particular of advantage when the table panel is displaceable and/or pivotable, since by determining the load distribution, any effect on the tipping stability of the operating table may be counteracted in a timely manner.

Preferably the sensors of the force measurement system are incorporated into the supporting elements. The space required for installation of the force measurement system can therefore be kept very small. In particular, it is possible to retrofit existing operating tables with a force measurement system.

An individual sensor of the force measurement system may be incorporated into each supporting element. It is especially advantageous for each supporting element to have at least two sensors, preferably at least four sensors, since by this the accuracy of measurement which can be achieved by means of the force measurement system is increased.

In a particularly preferred embodiment of the operating table, the supporting elements are formed as cardan joints having two pivot bolts, which are pivotably mounted about pivot axes aligned respectively parallel to and at right angles to the longitudinal axis of the table panel. The load acting on at least one of the pivot bolts are ascertainable by means of at least one sensor of the force measurement system. By means of the cardan joints, the table panel may be pivoted both about a pivot axis aligned parallel to the longitudinal axis of the table panel and also about a pivot axis aligned at right angles to the longitudinal axis of the table panel. For this, three cardan joints are preferably used. Preferably the cardan joints are in each case mounted on a lifting device, so that they can be adjusted as to their height relative to a support plate of the support column. The lifting device may be driven for example manually, electrically, hydraulically, or pneumatically.

Preferably a plurality of sensors of the force measurement system is assigned to each cardan joint, in particular two or four sensors. As already explained, the accuracy of measurement which can be achieved by the force measurement system can thereby be improved.

In a preferred embodiment, the force measurement system has sensors for detecting a change in electrical resistance. The change in electrical resistance may be caused by a mechanical load which acts on a component of the operating table coupled to the sensors. The mechanical load acting can be determined by recording the change in electrical resistance. The sensors may deliver an electrical signal which is evaluated by evaluating electronics to which the sensors are connected.

The sensors may for example be provided in the form of strain gauges. These are preferably sensors of planar form, which are secured to a component of the operating table, preferably adhered to the component, and the electrical resistance of which is changed in the case of a deformation of the component. The deformation is caused by the mechanical loading and may be detected as a change in the electrical resistance of the sensor.

Preferably, each two strain gauges are aligned parallel to one another. It has been found that the accuracy of measurement is improved by this.

It is particularly advantageous for every four strain gauges to be assembled into a Wheatstone Bridge circuit. The accuracy of measurement is further improved by this; in particular compensation for temperature effects is possible. Wheatstone Bridges of this kind are known to the man skilled in the art. They have in each case two pairs of resistances which are connected in parallel, each pair of resistances having two electrical resistances connected in series.

As an alternative to or in addition to electrical sensors, in a especially preferred configuration of the operating table, the force measurement system has sensors which are sensitive to magnetic fields, for detecting a change in a magnetic field. Sensors of this kind allow for contact-free detection of measurement values. This enables, for example, a mechanical load to be determined by detecting the change, caused by the load, in a magnetic field. The determination of the mechanical load is thus effected on the principle of magnetostriction, i.e. the measurement principle is based on the fact that in the case of a mechanical deformation of a permanent magnet, the magnetic field effected by the permanent magnet changes. This change in magnetic field can be detected by means of sensors which are sensitive to magnetic fields, the sensors outputting an electrical signal in dependence on the change in the magnetic field that is caused by the mechanical load.

It is advantageous for at least one sensor which is sensitive to magnetic fields to be provided in the form of a coil. The coil may form a high resolution magnetic scanning unit, which detects, with precision, changes in a magnetic field.

In a preferred configuration, a magnetically coded ferromagnetic material is associated with at the least one sensor which is sensitive to magnetic fields, and the material is loadable by the weight of the table panel with the patient thereon. A shaft made from a ferromagnetic steel may for example be used as ferromagnetic material, the shaft being subjected to a mechanical load on account of the weight of the patient. The load leads to a small deformation of the shaft in dependence on the magnitude of the patient's weight. Since the shaft is magnetically coded, the magnetic field generated by the shaft changes in dependence on the mechanical load acting on the shaft, and this change in magnetic field may be detected by the at least one sensor which is sensitive to magnetic fields. In order to provide the magnetic field, the ferromagnetic material is magnetically coded by being locally magnetized. A magnetic structure is thus impressed on the material, this being permanently stored. The impressed magnetic structure leads to the formation of a magnetic field which changes according to the applied mechanical load.

It is advantageous for the ferromagnetic material to be formed as a hollow shaft and for the associated sensors which are sensitive to magnetic fields to be located within the hollow shaft. In this way the space required for installation of the force measurement system can be very greatly reduced.

Advantageously a signal processing element is located in the hollow shaft, and the sensors located in the hollow shaft are connected to the signal processing element.

In an especially preferred configuration, the ferromagnetic material forms a magnetically coded pivot bolt of a cardan joint. As already explained, the table panel may be mounted on the support column by means of the cardan joint. The mechanical load exerted by the table panel and the patient on this point is taken up by the magnetically coded pivot bolt and an electrical signal is output by means of sensors located in the pivot bolt in dependence on the applied mechanical load. Based on this signal, the weight of the patient and the distribution of the mechanical load may be determined. In addition, on the basis of this signal, the maximum pivot angle and the maximum displacement starting from a neutral position of the table panel may be determined in a constructionally straightforward manner.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
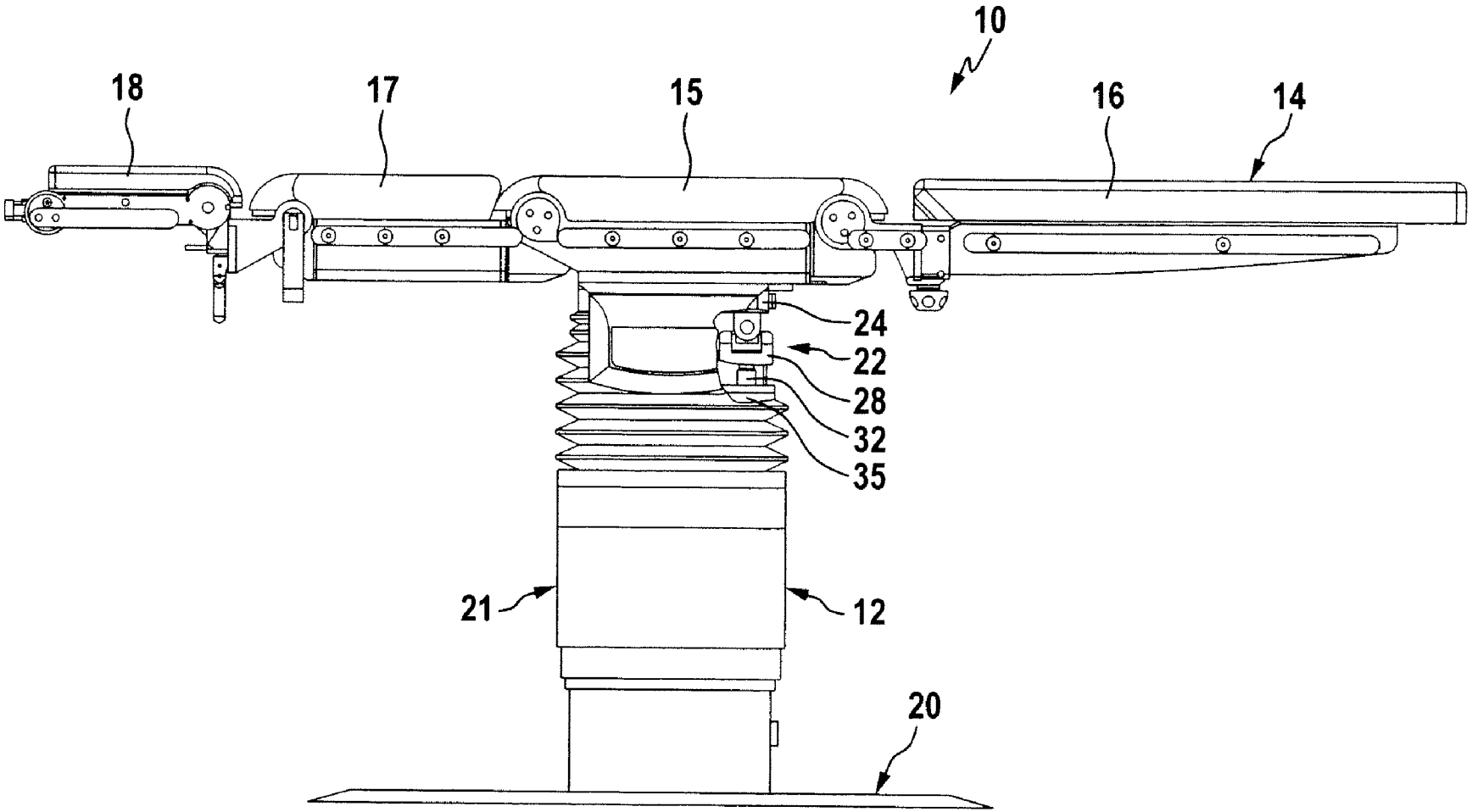
FIG. 1 shows a partially cut-away side view of an operating table according to the invention with a table panel and a support column.

An operating table 10 is schematically illustrated in FIG. 1. The table has a support column 12, which is adjustable as to its height and on which a table panel 14 is releasably mounted. The table panel 14 is formed as a multi-part unit; it comprises a base segment 15 mounted on the support column 12, to one side of which a leg segment 16 is pivotably mounted, and to the other side of which, a back segment 17 is pivotably mounted, in each case pivotable about a horizontal pivot axis. A head segment 18 is pivotably mounted on the back segment 17. Alternatively, the table panel 14 may of course also be formed as a unitary item.

The support column 12 comprises a base plate 20, to which a column shaft 21 is secured, the shaft carrying a column head 22 at its upper end. The column head is illustrated schematically in FIG. 2. The base segment 15 of the table panel 14 is releasably mounted on the column head 22.

Figure 2:
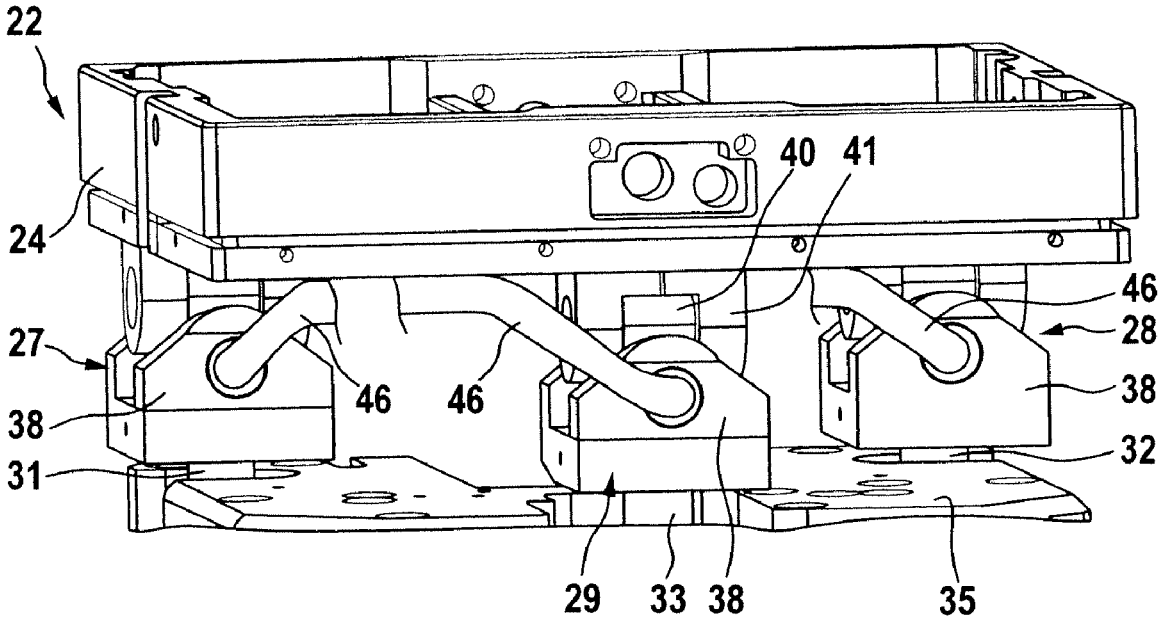
FIG. 2 shows a detailed view of a column head of the support column from FIG. 1.
Figure 3:
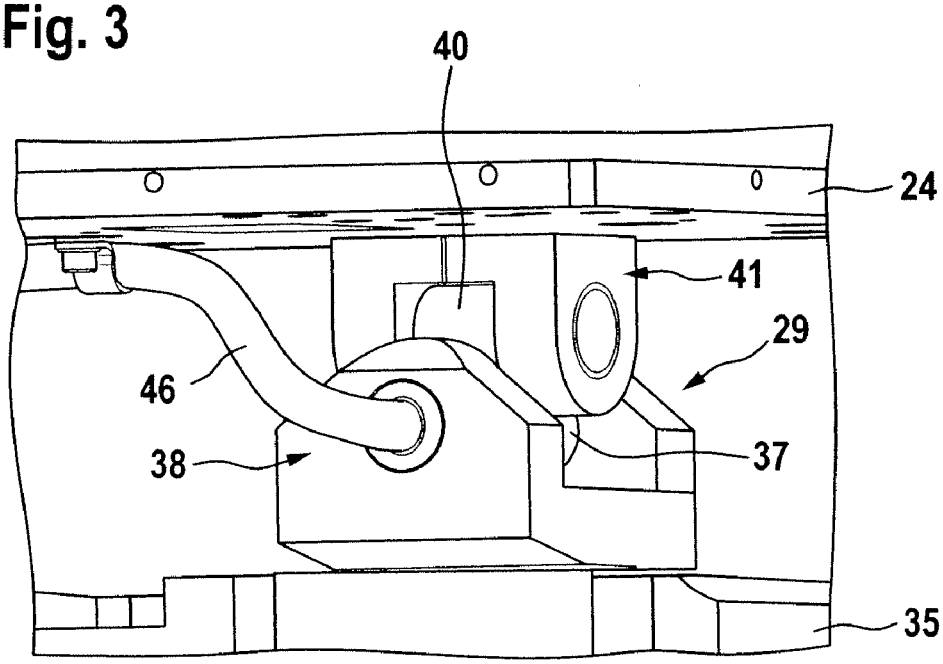
FIG. 3 shows a perspective illustration of a cardan joint of the column head from FIG. 2.

As is clear in particular from FIG. 2, the column head 22 comprises a head plate 24, on the underside of which three cardan joints 27, 28 and 29 are located. Each of the cardan joints 27, 28 and 29 is mounted at the free end of a respective spindle 31, 32 and 33, which is adjustable as to its height by means of a drive element, which is known per se and is therefore not illustrated in the drawing. The drive elements are incorporated into the column shaft 21 and are secured to a support plate 35 of the column shaft 21. By raising the spindles 31, 32 and 33, the head plate 24 can be raised relative to the support plate 35. If the spindles 31, 32 and 33 are raised to the same extent, the table panel 14 is adjusted only in respect of its height with its alignment remaining the same. If the spindles 31, 32 and 33 are however raised unequally, the head plate 24 and the table panel 14 mounted on it thus carry out a pivoting movement, whereby the table panel 14 may be selectively pivoted about a pivot axis aligned parallel to the longitudinal axis of the table panel and about a pivot axis aligned at right angles to the longitudinal axis of the table panel.

Not illustrated in FIG. 2, in order to achieve a better overview, is an additional feature for preventing rotation of the head plate relative to the support plate 35. Rotation prevention features of this kind are known to the man skilled in the art and do not therefore need any more detailed explanation.

The cardan joints 27, 28 and 29 are formed identically. They have in each case a first pivot bolt 37, which is pivotably mounted in a U-shaped first bearing pedestal 38 about a pivot axis aligned at right angles to the longitudinal axis of the table panel. The first bearing pedestal 38 is secured at the free end of the respective spindle 31, 32 or 33. In addition, the cardan joints 27, 28 and 29 each have a second pivot bolt 40, which is seated on the first pivot bolt 37 and is pivotably mounted in a second bearing pedestal 41, which is likewise formed in the shape of a U, about a pivot axis aligned parallel to the longitudinal axis of the table panel. The second pedestal block 41 is secured to the underside of the head plate 24.

The cardan joints 27, 28 and 29 each form a supporting element by which the table panel 14 is mounted on the support column 12. In order to detect the mechanical load acting in each case on the cardan joints 27, 28 and 29, sensors are incorporated into the cardan joints 27, 28 and 29, these forming a force measurement system in combination with measuring electronics located in the column shaft 21, preferably between the head plate 24 and the support plate 35, the force measurement system enabling the weight of a patient on the table panel 14 to be determined.

Figure 4:
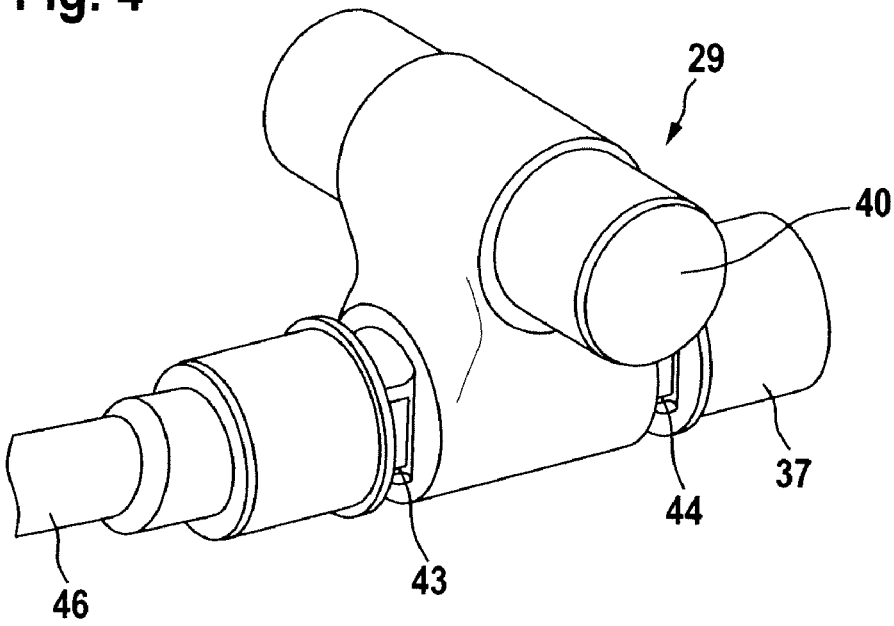
FIG. 4 shows a simplified illustration of the cardan joint from FIG. 3 with sensors of a force measurement system according to a first embodiment and FIG. 5 shows a partially cut-away simplified side view of the cardan joint from FIG. 3 with sensors of a force measurement system according to a second embodiment.

In the embodiment illustrated in FIG. 4, four sensors in the form of strain gauges are assigned to each cardan joint 27, 28 and 29, only two strain gauges 43, 44 being visible in FIG. 4. Each two strain gauges are fixed parallel to one another to the first pivot bolt 37 of each cardan joint 27, 28 and 29 by an adhesive connection, the second pivot bolt 40 being positioned between the two strain gauge pairs. The first pivot bolt 37 thus carries altogether four strain gauges, which are connected together electrically in the usual manner in the form of a Wheatstone measuring bridge. The mechanical load acting on the first pivot bolt 37 can be determined by means of the strain gauges 43, 44. Since corresponding strain gauges are associated with each cardan joint 27, 28 and 29, the total load acting on the column shaft 21 via the cardan joints 27, 28 and 29 can thus be determined, and moreover, the load distribution can be detected. The applied load is equal to the weight of the table panel 14 and of the head plate 24 along with the weight of the patient on the table panel 14. The weight of the patient can therefore be calculated from the total weight by subtracting the known weight of the table panel and the head plate.

The strain gauges 43, 44, which are in each case assigned to a first pivot bolt 37, are connected to a signal processing element located in the interior of the first pivot bolt 37, which is formed as a hollow shaft. The connection made by connecting wires, which are not shown in the drawing in order to achieve a better overview. A connecting cable 46 leads from this signal processing element to the central measuring electronics, already mentioned, which may be located, for example, in the column shaft 21. Based on the signals from the signal processing elements of the cardan joints 27, 28 and 29, an output signal is supplied by the measuring electronics, in dependence on the mechanical load acting on the cardan joints 27, 28 and 29. In dependence on this output signal, the maximum pivot angle to which the table panel 14 can be pivoted is likewise determined by a central control unit of the operating table 10, as is the maximum displacement through which the table panel 14 can be displaced relative to the support column 12 in the longitudinal direction of the table panel or also transverse to the longitudinal direction of the table panel. The maximum pivot angle and maximum displacement of the table panel 14 can thus be determined in dependence on the weight of the patient. The greater the weight of the patient, the smaller the maximum pivot angle and the maximum displacement that are selected, in order to ensure optimal stability of the operating table 10 in every instance.

Figure 5:
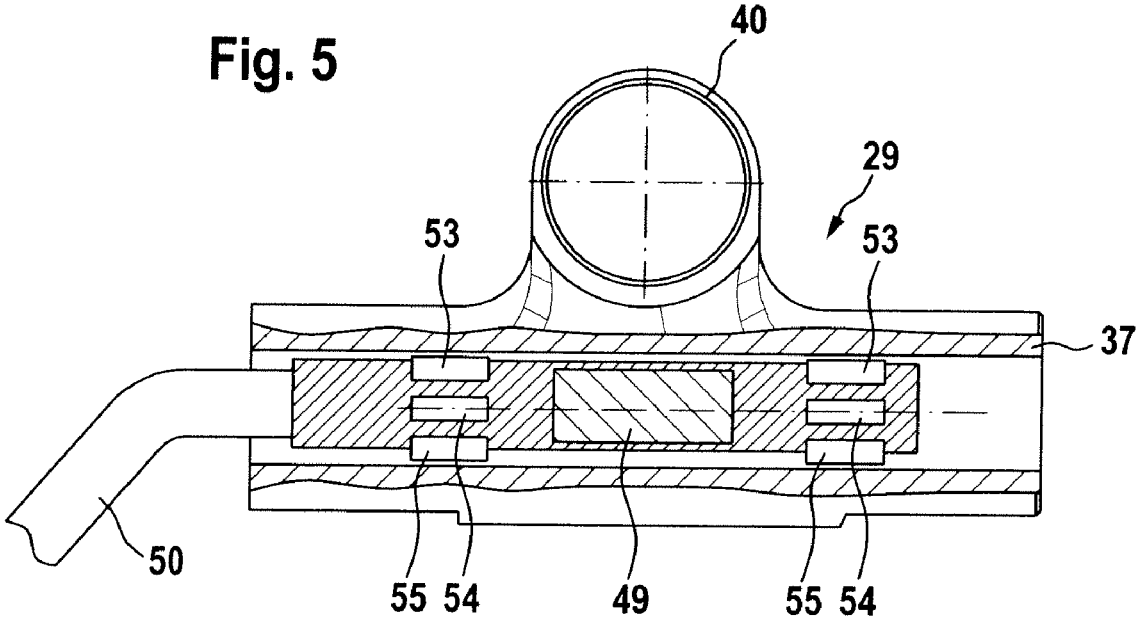

In FIG. 5, a second embodiment of a force measurement system is illustrated, which may be used for the operating table 10. In this construction also, the first pivot bolt 37 of the cardan joints 27, 28 and 29 is in each case formed as a hollow shaft, which carries in its interior a signal processing element 49, from which a connecting cable 50 leads to the exterior. The signal processing element 49 is connected to the central measuring electronics of the operating table 10 by the connecting cable 50, the central measuring electronics being located for example in the column shaft 21. In the embodiment illustrated in FIG. 5, the first pivot bolt 37 of the cardan joints 27, 28 and 29 is made from a ferromagnetic material, an industrial steel which contains between 1.5% and 8% of nickel preferably being used. The first pivot bolt 37 has a magnetic coding to each side of the second pivot bolt 40. Thus, to each side of the second pivot bolt 40, the ferromagnetic first pivot bolt 37 has been magnetically coded by a magnetic structure being impressed on it by application of a very strong external magnetic field. This magnetic structure is retained permanently by the first pivot bolt 37. In the region of the magnetic coding, four sensors that are sensitive to magnetic fields are located within the first pivot bolt 37, to each side of the second pivot bolt 40, the sensors being in the form of coils and each coil being connected to the signal processing element 49. In FIG. 5, in each case three coils 53, 54 and 55 are shown to each side of the second pivot bolt 40, in order to achieve a better overview. If a mechanical load acts on the magnetically-coded first pivot bolt 37, this leads to a change in the magnetic field detectable by the coils 53, 54 and 55. The change in the magnetic field is transmitted in the form of an electrical signal to the central measuring electronics via the connecting cable 50. From this signal the central measuring electronic determine from the loads acting on the individual cardan joints 27, 28 and 29, the weight of the patient on the table panel 14, as well as the load distribution.

In the embodiment shown in FIG. 5, the mechanical load is detected in a contact-free manner and with a very high precision of measurement. By using hollow shafts for the first pivot bolt 37, the force measurement system requires little additional space and is suited therefore also for retrofit to existing operating tables. As for the force measurement system already illustrated with reference to FIG. 4, by means also of the construction shown in FIG. 5, not only can the weight of the patient be determined, but in addition a maximum pivot angle and a maximum displacement may be determined in dependence on the weight of the patient, starting from the neutral position of the table panel 14 shown in FIG. 1.

What is claimed is:

1. An operating table comprising:

a support column, a table panel mounted on the support column, a force measurement system for determining the weight of the table panel and of a patient on the table panel, the force measurement system comprising:

a plurality of sensors arranged at a spacing from one another, and central measuring electronics to which the sensors are connected, a support plate, and a plurality of supporting elements, formed as cardan joints, by which the table panel is mounted on the support plate, wherein the sensors are incorporated into the supporting elements such that the load acting on each supporting element is detectable by means of at least one of said sensors.

2. An operating table according to claim 1, wherein the force measurement system is adapted to determine the location of the center of gravity of the table panel with the patient thereon.

3. An operating table according to claim 1, wherein the table panel is pivotable and/or displaceable, the maximum pivot angle and the maximum displacement relative to a neutral position of the table panel being controllable in dependence on an output signal of the force measurement system.

4. An operating table according to claim 1, wherein the table panel is releasably connected to the support column.

5. An operating table according to claim 1, wherein the force measurement system is incorporated into the support column.

6. An operating table according to claim 1, wherein a plurality of sensors is assigned to each cardan joint.

7. An operating table according to claim 1, wherein at least four sensors are assigned to each cardan joint.

8. An operating table according to claim 1, wherein the force measurement system has sensors for detecting a change in electrical resistance.

9. An operating table according to claim 8, wherein at least one sensor is provided in the form of a strain gauge.

10. An operating table according to claim 9, wherein each two strain gauges are aligned parallel to one another.

11. An operating table according to claim 9, wherein every four strain gauges are assembled into a Wheatstone Bridge circuit.

12. An operating table according to claim 1, wherein the force measurement system has at least one sensor which is sensitive to magnetic fields, for detecting a change in a magnetic field.

13. An operating table according to claim 12, wherein at least one sensor is provided in the form of a coil.

14. An operating table according to claim 12, wherein a magnetically coded ferromagnetic material is associated with the at least one sensor which is sensitive to magnetic fields, and the material is mechanically loadable by the weight of the table panel with the patient thereon.

15. An operating table according to claim 14, wherein the ferromagnetic material is formed as a hollow shaft, the at least one associated sensor which is sensitive to magnetic fields being located within the hollow shaft.

16. An operating table according to claim 15, wherein a signal processing element is located in the hollow shaft, the at least one sensor which is sensitive to magnetic fields and is located in the hollow shaft being connected to the signal processing element.

17. An operating table according to claim 14, wherein the ferromagnetic material forms a magnetically coded pivot bolt of a cardan joint.

* * * * *